US008016670B2

(12) United States Patent
LeMay et al.

(10) Patent No.: US 8,016,670 B2
(45) Date of Patent: Sep. 13, 2011

(54) VIRTUAL GLASS FOR A GAMING MACHINE

(75) Inventors: Steven G. LeMay, Reno, NV (US); John Goodman, Reno, NV (US); Gregory A. Schlottmann, Reno, NV (US)

(73) Assignee: IGT, Reno, NV (US)

( * ) Notice: Subject to any disclaimer, the term of this patent is extended or adjusted under 35 U.S.C. 154(b) by 1097 days.

(21) Appl. No.: 10/756,225

(22) Filed: Jan. 12, 2004

(65) Prior Publication Data

US 2005/0153776 A1 Jul. 14, 2005

(51) Int. Cl.
*A63F 9/00* (2006.01)
*A63F 9/24* (2006.01)

(52) U.S. Cl. ..... 463/30; 463/20; 463/31; 463/34; 273/138.1; 273/139; 273/148 B; 361/679.21

(58) Field of Classification Search ..... 463/30, 463/16, 20, 22, 25, 31–34, 46; 273/145 E, 273/148 B, 269, 280, 138.1, 139; 361/679.21, 361/679.26, 679.27, 679.28, 679.29
See application file for complete search history.

(56) References Cited

U.S. PATENT DOCUMENTS

| | | | | |
|---|---|---|---|---|
| 1,488,889 A | | 4/1924 | Lollis | |
| 3,864,024 A | | 2/1975 | Olson | |
| 4,127,849 A | * | 11/1978 | Okor | 345/441 |
| 4,448,419 A | | 5/1984 | Telnaes | |
| 4,614,342 A | | 9/1986 | Takashima | |
| 4,711,452 A | | 12/1987 | Dickinson et al. | |
| 4,838,552 A | | 6/1989 | Hagiwara | |
| 4,856,787 A | | 8/1989 | Itkis | |
| 4,932,147 A | | 6/1990 | David | |
| 5,026,152 A | | 6/1991 | Sharkey | |
| 5,135,224 A | | 8/1992 | Yamamoto et al. | |
| 5,239,227 A | | 8/1993 | Kikinis | |
| 5,342,047 A | | 8/1994 | Heidel et al. | |
| 5,413,357 A | | 5/1995 | Schulze et al. | |

(Continued)

FOREIGN PATENT DOCUMENTS

EP 0 134 979 A2 3/1985

(Continued)

OTHER PUBLICATIONS

Chinese Office Action dated Nov. 28, 2008 issued in 200580002282.8.

(Continued)

*Primary Examiner* — Arthur O. Hall
(74) *Attorney, Agent, or Firm* — Weaver Austin Villeneuve & Sampson LLP

(57) ABSTRACT

Various virtual glasses for providing visual and audio displays in a gaming machine are disclosed. Such virtual glasses may replace traditional gaming machine displays such as silk-screened glasses and secondary video screens. A virtual glass system comprises at least a host adapted to provide video content, a host storage unit adapted to store video content for the host, and a virtual glass in communication with the host. A standard virtual glass comprises at least a logic device, a storage unit, and a video display device. Multiples of each item may be present in each virtual glass system and/or virtual glass. In particular, the combined capacity of all virtual glass storage units is substantially less than the combined video content capacity of the host storage units. Additional devices can include remote hosts, remote virtual glasses, multiple hosts, networked systems and advanced logic devices capable of providing prioritization and increased functionality.

30 Claims, 5 Drawing Sheets

U.S. PATENT DOCUMENTS 5,524,888 A 6/1996 Heidel
5,580,055 A 12/1996 Hagiwara
5,634,080 A 5/1997 Kikinis et al.
5,680,160 A 10/1997 LaPointe
5,688,551 A 11/1997 Littman et al.
5,752,881 A 5/1998 Inoue
5,770,533 A 6/1998 Franchi
5,770,914 A 6/1998 Pease et al.
5,788,573 A 8/1998 Baerlocher et al.
5,803,453 A 9/1998 Stephan et al.
5,807,172 A 9/1998 Piechowiak
5,816,918 A 10/1998 Kelly et al.
5,839,957 A 11/1998 Schneider et al.
5,839,960 A 11/1998 Parra et al.
5,911,419 A 6/1999 Delaney et al.
5,924,926 A 7/1999 Brown
5,929,474 A 7/1999 Huang et al.
5,947,820 A 9/1999 Morro et al.
5,951,397 A 9/1999 Dickinson
5,965,907 A 10/1999 Huang et al.
5,971,271 A 10/1999 Wynn et al.
5,977,704 A 11/1999 Shi et al.
6,002,206 A 12/1999 Harrison et al.
6,008,784 A 12/1999 Acres et al.
6,016,176 A 1/2000 Kim et al.
6,027,115 A 2/2000 Griswold et al.
6,033,307 A 3/2000 Vancura
6,068,552 A 5/2000 Walker et al.
6,075,316 A 6/2000 Shi et al.
6,082,887 A 7/2000 Feuer et al.
6,135,884 A 10/2000 Hedrick et al.
6,155,925 A 12/2000 Giobbi et al.
6,162,121 A 12/2000 Morro et al.
6,166,496 A 12/2000 Lys et al.
6,205,690 B1 3/2001 Heropoulos et al.
6,229,505 B1 5/2001 Fujii
6,251,014 B1 6/2001 Stockdale et al.
6,254,481 B1 7/2001 Jaffe et al.
6,264,561 B1 7/2001 Saffari et al.
6,287,202 B1 * 9/2001 Pascal et al. ..... 463/42
6,315,666 B1 11/2001 Mastera et al.
6,366,016 B1 4/2002 Sakaguchi et al.
6,368,216 B1 * 4/2002 Hedrick et al. ..... 463/20
6,406,371 B1 * 6/2002 Baba et al. ..... 463/42
6,454,649 B1 9/2002 Mattice et al.
6,464,581 B1 10/2002 Yoseloff et al.
6,485,884 B2 11/2002 Wolk et al.
6,502,758 B2 1/2003 Cottrell
6,503,147 B1 1/2003 Stockdale et al.
6,517,433 B2 2/2003 Loose et al.
6,530,165 B2 3/2003 Griesemer et al.
6,609,968 B1 8/2003 Okada et al.
6,638,165 B2 10/2003 Uchiyama et al.
6,659,866 B2 12/2003 Frost et al.
6,722,987 B2 4/2004 Orr et al.
6,743,094 B2 6/2004 Johnson
6,743,102 B1 6/2004 Fiechter et al.
6,773,345 B2 8/2004 Walker et al.
6,798,148 B2 9/2004 Inukai
6,817,946 B2 * 11/2004 Motegi et al. ..... 463/31
6,893,345 B2 5/2005 Motegi et al.
6,908,387 B2 6/2005 Hedrick et al.
6,911,781 B2 6/2005 Yamazaki et al.
6,923,720 B2 8/2005 Loose
6,939,226 B1 9/2005 Joshi
7,008,324 B1 * 3/2006 Johnson et al. ..... 463/42
7,048,629 B2 5/2006 Sines et al.
7,053,890 B2 5/2006 Inukai
7,121,945 B2 * 10/2006 Suganuma et al. ..... 463/34
7,169,048 B2 1/2007 Nozaki et al.
7,204,753 B2 4/2007 Ozaki et al.
7,335,101 B1 2/2008 Luciano, Jr.
7,542,198 B2 6/2009 Kothari
7,682,249 B2 3/2010 Winans et al.
7,811,170 B2 10/2010 Winans et al.
2002/0012898 A1 1/2002 Shechter et al.
2002/0082083 A1 * 6/2002 Ito et al. ..... 463/41
2002/0142846 A1 10/2002 Paulsen
2002/0173354 A1 11/2002 Winans et al.
2002/0187831 A1 12/2002 Arikawa et al.
2003/0032479 A1 2/2003 LeMay et al.
2003/0045343 A1 3/2003 Luccesi et al.
2003/0060269 A1 3/2003 Paulsen et al.
2003/0064784 A1 4/2003 Wells et al.
2003/0195045 A1 10/2003 Kaminkow et al.
2003/0220134 A1 11/2003 Walker et al.
2003/0232651 A1 12/2003 Huard et al.
2004/0082385 A1 4/2004 Silva et al.
2004/0142745 A1 * 7/2004 Hosaka ..... 463/31
2004/0219978 A1 * 11/2004 Teramoto et al. ..... 463/32
2005/0054440 A1 3/2005 Anderson et al.
2005/0272505 A1 12/2005 Okamura
2006/0014580 A1 1/2006 Hawthorn
2006/0100013 A1 5/2006 Enzminger
2007/0004510 A1 1/2007 Underdahl et al.
2007/0052660 A1 3/2007 Montbach et al.
2007/0054730 A1 3/2007 Mattice et al.
2007/0093290 A1 4/2007 Winans et al.
2007/0293299 A1 12/2007 Aida
2008/0020827 A1 1/2008 Underdahl et al.
2008/0096624 A1 4/2008 Rydberg
2008/0200233 A1 8/2008 Aida
2009/0104969 A1 4/2009 Paulsen et al.

FOREIGN PATENT DOCUMENTS

EP 0 246 021 A2 11/1987
EP 0 288 152 B1 10/1988
EP 0896308 A1 2/1999
EP 1 082 980 A2 3/2001
EP 1082980 A2 * 3/2001
EP 1 291 829 3/2003
EP 1 422 673 5/2004
EP 1 550 987 7/2005
GB 2092795 8/1982
GB 2116345 9/1983
GB 2253299 9/1992
GB 2447481 9/2008
JP 2002-360908 12/2002
JP 2004-081826 3/2004
JP 2004-089689 3/2004
WO WO 98/03962 1/1998
WO WO 98/50804 11/1998
WO WO 00/55879 9/2000
WO WO 00/60669 10/2000
WO WO 02/17613 2/2002
WO WO 02/091319 11/2002
WO WO 2005/071628 8/2005
WO WO 2005/114600 12/2005
WO WO 2008/030781 3/2008
WO WO 2008/057929 5/2008
WO WO 2010/042328 4/2010

OTHER PUBLICATIONS

U.S. Appl. No. 12/247,844, filed Oct. 8, 2008, Paulsen et al.
International Preliminary Report on Patentability dated Jul. 27, 2006 issued in PCT/US2005/000387.
International Search Report dated Apr. 16, 2008 issued in PCT/US2007/083315.
Written Opinion dated Apr. 16, 2008 issued in PCT/US2007/083315.
International Search Report dated Apr. 9, 2008 issued in PCT/US2007/077453.
Written Opinion dated Apr. 9, 2008 issued in PCT/US2007/077453.
Russian Office Action dated Dec. 15, 2006 issued in 2006124191/09 (026231).
Russian Office Action dated Dec. 8, 2008 issued in 2006124191/09 (026231).
US Notice of Allowance dated Sep. 22, 1999 issued in U.S. Appl. No. 09/047,889.
US Office Action dated Mar. 30, 1999 issued in U.S. Appl. No. 09/047,889.
US Office Action dated Mar. 24, 2003 issued in U.S. Appl. No. 09/964,962.
US Office Action dated Oct. 7, 2003 issued in U.S. Appl. No. 09/964,962.

US Final Office Action dated Apr. 26, 2004 issued in U.S. Appl. No. 09/964,962.
US Office Action dated May 2, 2006 issued in U.S. Appl. No. 09/964,962.
US Office Action (Interview Summary) dated Jul. 10, 2006 issued in U.S. Appl. No. 09/964,962.
US Final Office Action dated Dec. 7, 2006 issued in U.S. Appl. No. 09/964,962.
US Office Action dated Sep. 20, 2007 issued in U.S. Appl. No. 09/964,962.
US Final Office Action dated Aug. 8, 2008 issued in U.S. Appl. No. 09/964,962.
AV Video Multimedia Producer (Jun. 2001) "Announce World's First Video-Capable Flexible Plastic LCD Display" [online] [retrieved on Mar. 17, 2003] Retrieved from: http://www.avvideo.com/2001/06_jun/news/plastic_video.htm, 3 pp.
Planar Operations Manual (prior to Jan. 1997) "Electroluminescent Display" Planar America, Inc., 1400 NW Campton Drive, Beaverton, Oregon 97006, 3 pp.
Del Conte, Natali T. (Aug. 29, 2006) "Philips Demos Digital Game Board"[online] [retrieval date unknown] Retrieved from: http://www.pcmag.com/article2/0,1895,2009874,00.asp, 2 pp.
Display of "High Rollers Triple Diamond" Gaming Machine at a casino in Nevada in about 1995 (photograph of similar machine) 2 pp.
Schröder, Tim (Feb. 28, 2005) "Microelectronics Display Panels with Electronic Ink", *Fraunhofer Magazin*,Fraunhofer Gesellschaft, Muenchen, DE, 2:38-39, XP-002344237.
"First Generation Electronic Paper Display From Philips, Sony and E Ink to be Used in New Electronic Reading Device", (Mar. 24, 2004) [online] [retrieved on Sep. 8, 2005] Retrieved from: URL:http://www.eink.com/news/releases/pr70.html, 2 pp. XP-002344236.
"FOLED Flexible Organic Light Emitting Device," Universal Display Corporation [online] [retrieved on Apr. 26, 2001] Retrieved from: http://www.universaldisplay.com/foled.php, 2 pp.
Kavoossi B, (Dec. 12, 2001) "Printed Micro Systems on Paper", [online] [retrieved on Sep. 9, 2005] Retrieved from: URL:http://www.tekes.fi/julkaisut/Active_imaging.pdf, pp. 1-106, XP-002344235.
Lieberman, David, (Jun. 15, 1999) "Push is on to Replace Glass with Plastic in LCDs,"[online] [retrieved Sep. 6, 2000] Retrieved from: http://www.eetimes.com/story/OEG19990615S0031, EETIMES.com, *The Technology Site for Engineers and Technical Management*, pp 1-4.
"The Tube"(Mar. 6, 2000) Businessweek Online [online] [retrieved on Dec. 20, 2001] Retrieved from: http://www/businessweek.com:/2000/00_10/design3.htm?scriptFramed, pp. 1-2.
European Office Action dated Apr. 24, 2009 issued in 05705161.7.
Mexican Office Action dated May 12, 2009 issued in 06/07949.
U.S. Final Office Action dated Apr. 21, 2009 issued in U.S. Appl. No. 09/964,962.
U.S. Office Action dated Jul. 6, 2009 issued in U.S. Appl. No. 09/964,962.
U.S. Office Action dated Jun. 23, 2009 issued in U.S. Appl. No. 11/517,861.
U.S. Office Action dated Jun. 25, 2009 issued in U.S. Appl. No. 11/880,937.
US Office Action dated Jun. 25, 2010 issued in U.S. Appl. No. 11/592,614.
US Examiner Interview Summary dated Sep. 18, 2009 issued in U.S. Appl. No. 11/517,861.
US Office Action dated Mar. 15, 2010 issued in U.S. Appl. No. 11/517,861.
US Office Action dated Jun. 25, 2009 issued in U.S. Appl. No. 11/880,937.
US Examiner Interview Summary dated Sep. 18, 2009 issued in U.S. Appl. No. 11/880,937.
US Office Action Final dated Mar. 16, 2010 issued in U.S. Appl. No. 09/964,962.
US Office Action dated Oct. 5, 2005 issued in U.S. Appl. No. 10/139,801.
US Office Action Final dated Mar. 16, 2006 issued in U.S. Appl. No. 10/139,801.
US Office Action dated Jul. 6, 2006 issued in U.S. Appl. No. 10/139,801.
US Office Action Final dated Jan. 5, 2007 issued in U.S. Appl. No. 10/139,801.
US Advisory Action dated Apr. 4, 2007 issued in U.S. Appl. No. 10/139,801.
US Examiner Interview Summary dated Apr. 26, 2007 issued in U.S. Appl. No. 10/139,801.
US Office Action dated Jun. 4, 2007 issued in U.S. Appl. No. 10/139,801.
US Office Action Final dated Feb. 21, 2008 issued in U.S. Appl. No. 10/139,801.
US Office Action dated Aug. 20, 2008 issued in U.S. Appl. No. 10/139,801.
US Office Action dated Jan. 30, 2009 issued in U.S. Appl. No. 10/139,801.
US Examiner Interview Summary dated Aug. 13, 2009 issued in U.S. Appl. No. 10/139,801.
US Notice of Allowance dated Sep. 14, 2009 issued in U.S. Appl. No. 10/139,801.
US Notice of Allowance dated Dec. 2, 2009 issued in U.S. Appl. No. 10/139,801.
US Office Action dated Oct. 31, 2008 issued in U.S. Appl. No. 11/546,659.
US Office Action dated May 12, 2009 issued in U.S. Appl. No. 11/546,659.
US Examiner Interview Summary dated Aug. 12, 2009 issued in U.S. Appl. No. 11/546,659.
US Notice of Allowance dated Apr. 20, 2010 issued in U.S. Appl. No. 11/546,659.
AU Examiner's First Report dated Nov. 13, 2009 issued in 2005207295.
Chinese Second Office Action dated Mar. 1, 2010 issued in 200580002282.8.
European Examination Report dated Oct. 30, 2009 issued in 07 863 774.1-2221.
European Examination Report dated Jun. 4, 2010 issued in 07 863 774.1-2221.
PCT International Search Report and Written Opinion dated Jan. 21, 2010 issued in PCT/US2009/058261.
PCT International Search Report dated Aug. 14, 2003 issued in PCT/US02/13863.
PCT Written Opinion dated Sep. 24, 2009 issued in PCT/US02/13863.
PCT International Preliminary Examination Report dated Nov. 24, 2003 issued in PCT/US02/13863.
Patent Abstracts of Japan vol. 2000, No. 09, Oct. 13, 2000 & JP 2000 172444 A (Semiconductor Energy Lab Co LTD), Jun. 23, 2000 abstract.
Patent Abstracts of Japan vol. 2000, No. 20, Jul. 10, 2001 & JP 2001 076886 A (Futaba Corp), Mar. 23, 2001 abstract.
Australian Examiner's First Report dated Feb. 16, 2007 issued in AU 2002256429.
Australian Examiner's First Report dated Jan. 15, 2009 issued in AU 2007216701.
EP Examination Report dated Dec. 9, 2005 issued in EP 02 725 894.6-2218.
EP Examination Report dated Jan. 12, 2007 issued in EP 02 725 894.6-2218.
EP Examiner's Report dated Jul. 20, 2009 issued in EP 02 725 894.6-2218.
IBM, *Organic Light Emitting Diodes Project*, Apr. 16, 2002, http://www.almaden.ibm.com/st/projects/oleds/.
Kodak, *What It Is* Apr. 25, 2002 http://www.kodak.corn/US/en/corp/display/overview.jhtml.
Rolltronics, By Dr. James Sheats, *Introduction to Organic Light-Emitting Diodes* (*OLEDs*), Apr. 16, 2002, http://www.rolltronics.com/intro_oled.htp.
Universal Display Corporation, "From Passive to Active Matrix", Apr. 25, 2002, <http://www.universaldisplay.com/matrix.php>.
Universal Display Corporation, *FOLDED Flexible Organic Light Emitting Device*, Apr. 25, 2002, http://www.universaldisplay.com/foled.php.

PCT International Search Report, Jun. 6, 2005.
PCT Written Opinion of the International Searching Authority, Jun. 6, 2005.
US Office Action Final dated Nov. 1, 2010 issued in U.S. Appl. No. 11/592,614.
US Office Action Final dated Jan. 21, 2010 issued in U.S. Appl. No. 11/880,937.
US Office Action Final dated Aug. 16, 2010 issued in U.S. Appl. No. 09/964,962.
US Office Action dated Dec. 21, 2010 issued in U.S. Appl. No. 09/964,962.
US Examiner Interview Summary dated Mar. 10, 2011 issued in U.S. Appl. No. 09/964,962.
US Notice of Allowance dated Apr. 1, 2011 issued in U.S. Appl. No. 09/964,962.
US Notice of Allowance dated Aug. 26, 2010 issued in U.S. Appl. No. 11/546,659.
PCT International Search Report dated Jun. 6, 2005 issued in PCT/US2005/000387.
PCT Written Opinion dated Jun. 6, 2005 issued in PCT/US2005/000387.
PCT International Preliminary Report on Patentability and Written Opinion dated Jul. 17, 2006 issued in PCT/US2005/000387.
AU Notice of Acceptance dated Aug. 25, 2010 issued in 2005207295.
Canadian Office Action dated Apr. 12, 2011 issued in CA 2,552,400.
Chinese Third Office Action dated Feb. 16, 2011 issued in 200580002282.8.
PCT International Preliminary Report on Patentability and Written Opinion dated Apr. 21, 2010 issued in PCT/US2009/058261.

* cited by examiner

VIRTUAL GLASS FOR A GAMING MACHINE

TECHNICAL FIELD

The present invention relates generally to an apparatus and method for providing displays in an electronic device, and more specifically to an apparatus and method for generating and controlling visual and audio displays in a gaming machine.

BACKGROUND

Casinos and other forms of gaming comprise a growing multi-billion dollar industry wherein floor space is at a premium, such that newer, more popular and increasingly sophisticated games and machines are preferred over older and less popular ones. For example, the casino and gaming industries have experienced a marked shift over the past few decades not only from the prevalence of table games to gaming machines, but also from the use of fully mechanical gaming machines to electronic and microprocessor based gaming machines. In a typical gaming machine, such as a video poker or slot machine, a game play is first initiated through a player wager of money or credit, whereupon the gaming machine determines a game outcome, presents the game outcome to the player and then potentially dispenses an award of some type, including a monetary award, depending on the game outcome. Although this process is generally true for both mechanical and electronic gaming machines, the electronic machines tend to be more popular with players and thus more lucrative for casinos for a number of reasons, such as increased game varieties, more attractive and dynamic presentations and the ability to award larger jackpots.

Electronic and microprocessor based gaming machines can include a number of hardware and software components to provide a wide variety of game types and game playing capabilities, with such hardware and software components being generally well known in the art. A typical electronic gaming machine comprises a central processing unit ("CPU") or master gaming controller ("MGC") that controls various combinations of hardware and software devices and components that encourage game play, allow a player to play a game on the gaming machine and control payouts and other awards. Software components can include, for example, boot and initialization routines, various game play programs and subroutines, credit and payout routines, image and audio generation programs, various component modules and a random number generator, among others. Exemplary hardware devices can include bill validators, coin acceptors, card readers, keypads, buttons, levers, touch screens, coin hoppers, ticket printers, player tracking units and the like.

In addition, each gaming machine can have various audio and visual display components that can include, for example, speakers, display panels, belly and top glasses, exterior cabinet artwork, lights, and top box dioramas, as well as any number of video displays of various types to show game play and other assorted information, with such video display types including, for example, a cathode ray tube ("CRT"), a liquid crystal display ("LCD"), a light emitting diode ("LED"), a flat panel display and a plasma display, among others. Apparatuses and methods for providing displays in gaming machines and/or within a casino are generally well known, and instances of such apparatuses and methods can be found in, for example, U.S. Pat. Nos. 5,971,271; 6,135,884; 6,251,014; and 6,503,147, all of which are incorporated herein by reference in their entirety and for all purposes. Although these examples and the following discussion and illustrative examples are directed primarily to casino and gaming machine display devices and systems, it should be borne in mind that these are all merely exemplary in nature, and that these and other similar display devices and systems can also be applied and used in other types of establishments, venues and items.

Continuing within the context of a casino or gaming establishment, the use of quality visual and audio display components to encourage, heighten and maintain interest in game play is often an important consideration for a casino operator or gaming establishment proprietor. Variety and interchangeability in games and machine displays are also important characteristics, as interest in any given game or display tends to decrease over time. Electronic gaming machines have traditionally been relatively simple, however, in that the various displays, functions and peripheral devices associated with any particular gaming machine are usually limited for any given machine. In general, the functionality of a traditional gaming machine has been relatively constant in that new displays, themes, peripheral devices and gaming software are infrequently added to any particular machine once that machine has been deployed. In addition, the connections, communication protocols, and software drivers for many peripheral devices are often customized and proprietary, varying from manufacturer to manufacturer and from peripheral device to peripheral device, such that the swapping out of different model peripherals is usually impractical.

Although it may become desirable to change a game theme or add new capabilities or features to a particular gaming machine once that machine has been deployed, such changes can be expensive and particularly difficult if new or updated gaming software and/or peripheral devices are involved. In even a simple example, the creation and installation of artwork and information on various gaming machine displays, such as a top glass and belly glass, is a very resource intensive task. Typically, artwork is silk-screened onto a top glass or belly glass (which can be glass or plastic) by a controlled and expensive process. Because these displays are usually backlit such that light shines through the glass, the quality of the silk-screen process must be high to ensure that pinholes or other defects in the painted areas are not present. Even a simple retrofit of a gaming machine to provide a different theme can involve the replacement of a top glass, a belly glass, and reel strips (on a spinning reel slot machine), among other items. Although often desirable, such retrofitting results in at least the costs of purchasing and installing new silk-screened glasses, even where new software and/or other electronic components are not needed. Hence, retrofitting a machine to generate and maintain interest in game play can represent a significant expense to a casino.

Another method of gaining and maintaining interest in game play is to provide a gaming machine with a plurality of games. Although gaming machines have traditionally provided only a single game per machine, recent innovations have resulted in machines that permit a player to select from a number of different games on the same machine. Such multi-game machines typically have the same exterior artwork, top glass and belly glass for whichever game is selected, however, such that these display items tend to be fairly generic in nature on these machines. It is entirely impractical to have a single multi-game machine with standard silk-screened glasses and other permanent displays that reflect, for example, both an "Elvis" themed game and a "Star Wars" themed game available on the same machine.

Although the issue of variable visual displays has been partially addressed through recent introductions of secondary and even tertiary video screens, such video screens tend to be relatively expensive and event-driven media-slave devices, the use of which results in a need for substantial associated memory or storage units and the additional power and space required to accommodate such displays and units. Furthermore, these added video screens are limited in that they are restricted to a single video image source or "host" within the gaming machine itself, such as the MGC or an associated video control slave chip, and can only display that which has already been programmed into the host or any of its associated memory units. As a result, any newly desired game or display changes in a deployed machine still results in the need for undesirable retrofitting and/or software upgrades and updates.

In view of the above observations, it would be desirable to provide a visual display for a gaming machine that reduces the costliness and inconvenience of updating thematic displays on the gaming machine glasses. It would also be desirable to provide a visual display with increased flexibility, such that a variety of hosts and image sources can be associated with the display. Accordingly, there exists a need for improved apparatuses and methods for providing visual displays associated with a gaming machine, and in particular for such improved apparatuses and methods to permit an increased variety of readily interchangeable visual displays with reduced power and space requirements and less memory or storage incorporated into the actual display components.

SUMMARY

It is an advantage of the present invention to provide an apparatus and method for generating and controlling visual and audio displays in a gaming machine. The provided apparatus and method involve the use of one or more virtual glasses in association with a gaming machine, whereby various traditional gaming machine displays such as silk-screened glasses and secondary video screens are replaced. This is accomplished by providing a streamlined, low power, low cost, low space requirement video display unit that is able to display static and animated images using a minimum amount of internal storage and requiring minimal MGC use.

In one embodiment, a virtual glass system has at least one host adapted to present video content to a virtual glass, at least one host storage unit adapted to store video content accessible to the host, and at least one virtual glass in communication with the host. A standard virtual glass has at least one logic device, at least one storage unit, and one video display device, although the virtual glass storage units are so small that the combined capacity of all virtual glass storage units is substantially less than the combined video content capacity of all host storage units.

According to other embodiments of the present invention, the provided apparatus and method involve the use of remote hosts, remote virtual glasses, multiple hosts, networked systems and more advanced logic devices capable of providing necessary prioritization and increased functionality within a virtual glass.

Other methods, features and advantages of the invention will be or will become apparent to one with skill in the art upon examination of the following figures and detailed description. It is intended that all such additional methods, features and advantages be included within this description, be within the scope of the invention, and be protected by the accompanying claims.

BRIEF DESCRIPTION OF THE DRAWINGS

The included drawings are for illustrative purposes and serve only to provide examples of possible structures and process steps regarding the use and implementation of a virtual glass in or about a gaming machine. These drawings in no way limit any changes in form and detail that may be made to the invention by one skilled in the art without departing from the spirit and scope of the invention.

DETAILED DESCRIPTION

An example application of an apparatus and method according to the present invention is described in this section. This example is being provided solely to add context and aid in the understanding of the invention. It will thus be apparent to one skilled in the art that the present invention may be practiced without some or all of these specific details. In other instances, well known features and process steps have not been described in detail in order to avoid unnecessarily obscuring the present invention. Other applications are possible, such that the following example should not be taken as definitive or limiting either in scope or setting.

In the following detailed description, references are made to the accompanying drawings, which form a part of the description and in which are shown, by way of illustration, specific embodiments of the present invention. Although these embodiments are described in sufficient detail to enable one skilled in the art to practice the invention, it is understood that these examples are not limiting; such that other embodiments may be used, and changes may be made without departing from the spirit and scope of the invention. In particular, and as referenced previously, while the inventive virtual glass apparatuses and methods disclosed herein are described primarily with references to and illustrations of gaming establishments and gaming machines, these apparatuses and methods are readily adaptable for use in other types of businesses and environments, such that their use is not restricted exclusively to gaming machines or within a casino or gaming establishment.

Figure 1:
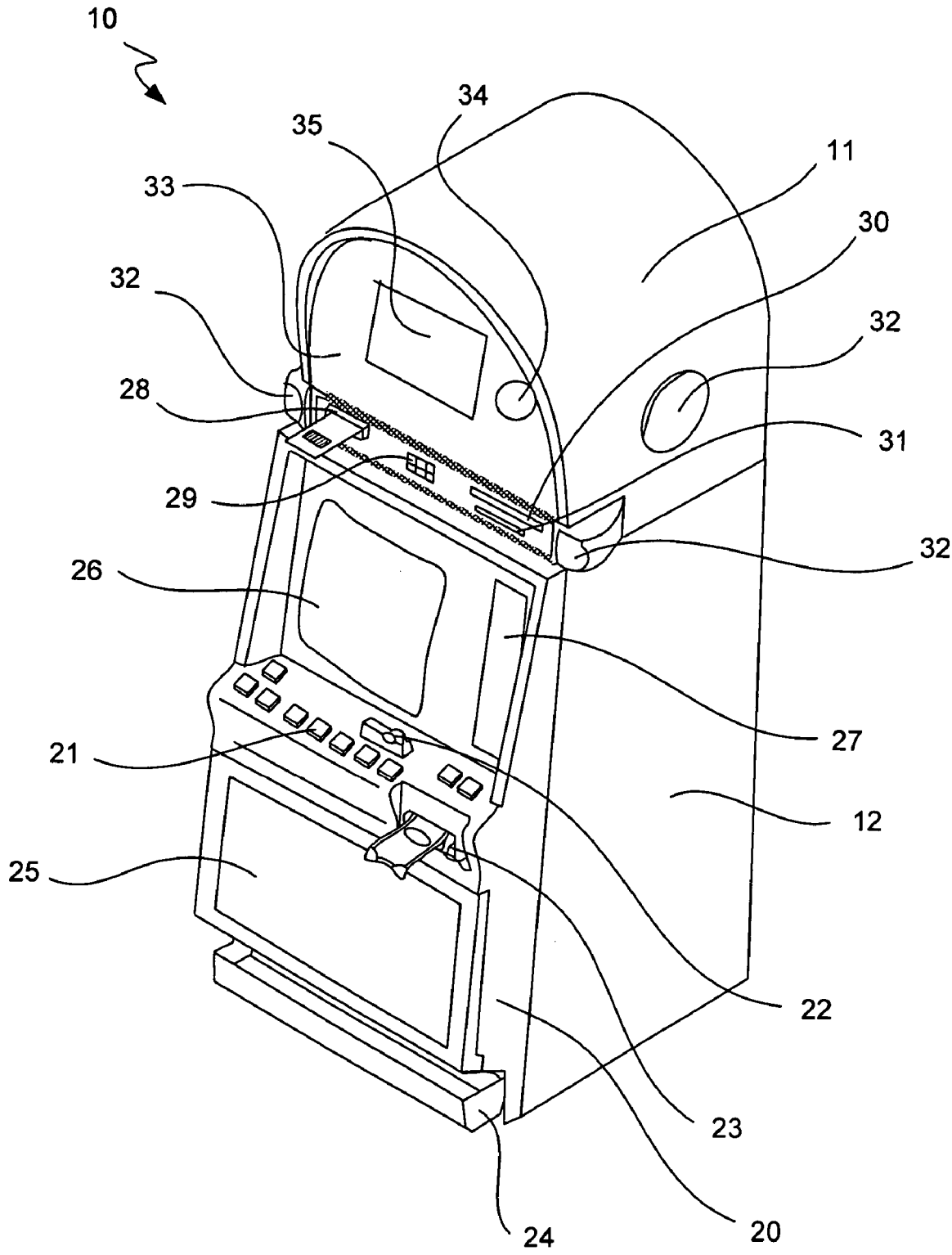
FIG. 1 illustrates in perspective view an exemplary gaming machine.

Continuing with the illustrative example of apparatuses and methods employed within a casino or other gaming establishment, an exemplary gaming machine is illustrated in perspective view in FIG. 1. Gaming machine 10, which is a gaming device that is generally adapted for accepting wagers and granting monetary awards, includes a top box 11 and a main cabinet 12, which generally surrounds the machine interior (not shown) and is viewable by users. Main cabinet 12 includes a main door 20 on the front of the machine, which opens to provide access to the interior of the machine. Attached to the main door are typically one or more player-input switches or buttons 21, one or more money or credit acceptors, such as a coin acceptor 22, and a bill or ticket validator 23, a coin tray 24, and a belly glass 25. Viewable through main door 20 is a primary video display monitor 26 and one or more informational side panels or side panel glasses 27. The primary video display monitor 26 can generally be used for presenting a main game and other pertinent information, and will typically be a CRT, high resolution flat-panel LCD, plasma/LED display or other conventional electronically controlled video monitor.

Top box 11, which typically rests atop of the main cabinet 12, may contain a ticket printer 28, a keypad 29, one or more additional displays 30, a card reader 31, one or more speakers 32, and a top glass 33. In addition, top box 11 may also contain items situated within the top glass 33, such as one or more cameras 34, and one or more secondary video display monitors 35, which can generally be used for presenting a secondary or bonus game, ancillary information, pay tables, artwork and/or advertisements, and which may also be a CRT, high resolution flat-panel LCD, plasma/LED display or other conventional electronically controlled video monitor. One example of a use and description for a secondary or additional display associated with a gaming machine is disclosed in commonly assigned U.S. Pat. No. 6,315,666 to Mastera, et al., entitled "Gaming Machines Having Secondary Display for Providing Video Content," which patent is incorporated herein in its entirety and for all purposes. While the foregoing example places various gaming machine items and peripherals in specific locations for purposes of illustration, it is generally understood that all illustrated items may not be present on every gaming machine, that all such items can be located in different places on or about the machine, and that other items and peripherals, such as a top box diorama, for example, can also be present.

Figure 2:
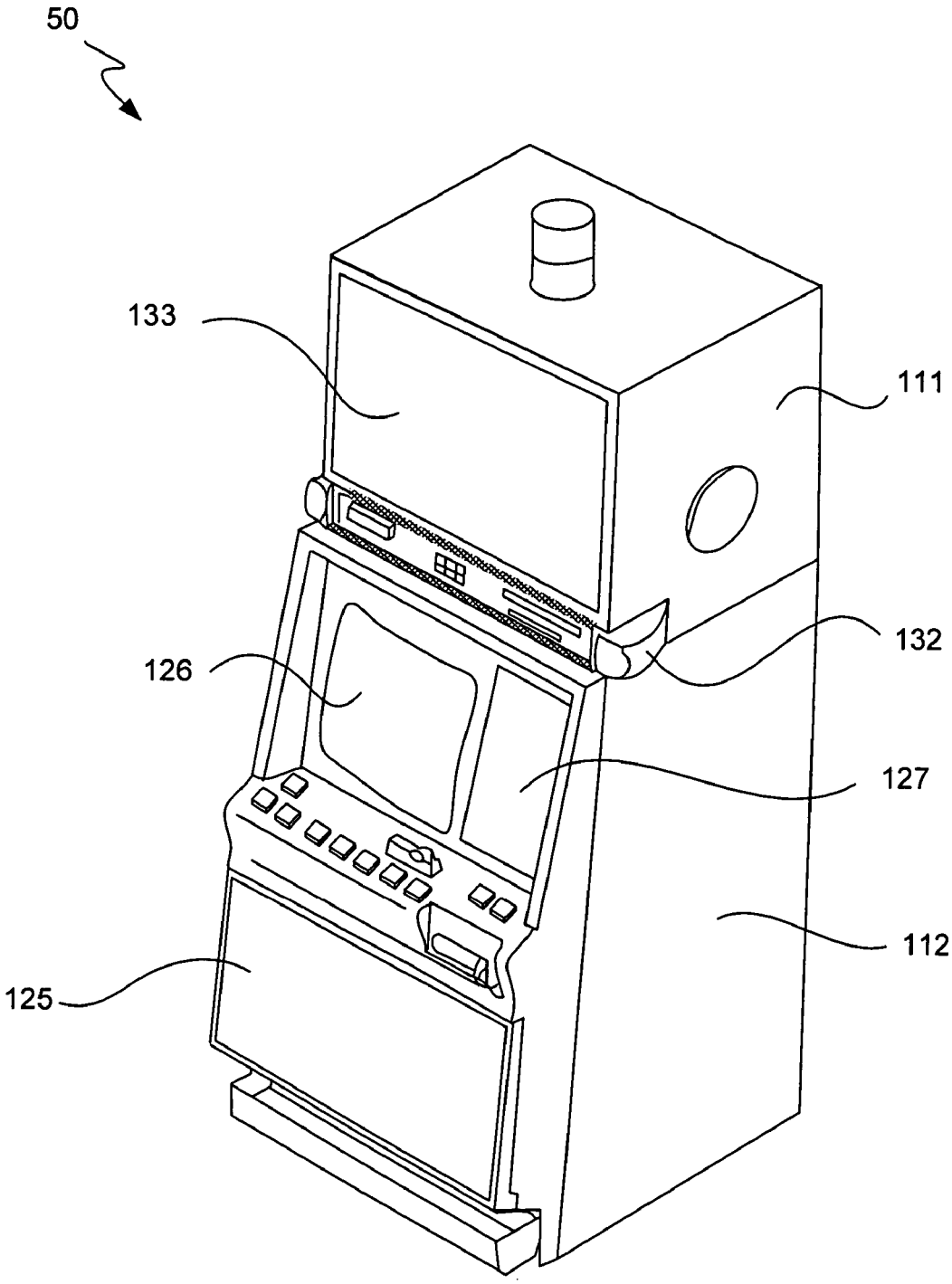
FIG. 2 illustrates in perspective view an alternative gaming machine according to one embodiment of the present invention.

With reference to FIG. 2, an alternative gaming machine according to one embodiment of the present invention is illustrated in perspective view. Similar to the previous gaming machine 10 of FIG. 1, alternative gaming machine 50 is also a gaming device that is generally adapted for accepting wagers and granting monetary awards. Although alternative gaming machine 50 is generally more box-like than the previous gaming machine 10 of FIG. 1, such a difference is considered insubstantial for purposes of the present invention. In fact, it is specifically contemplated that every inventive virtual glass embodiment disclosed herein can be used in conjunction with all gaming machines of any shape or size, with appropriate adaptations or adjustments made as necessary. As in the previous example, gaming machine 50 includes a top box 111 and a main cabinet 112, both of which have a number of features substantially similar to those found in the previous gaming machine, such as a primary video display monitor 126 and one or more speakers 132.

Gaming machine 50 also includes one or more virtual glasses, which are essentially peripheral auxiliary video display units in communication with one or more hosts, such as the MGC or some other CPU. Such virtual glasses are not under direct control of the MGC or any other host, and as such are not a key component of the MGC or other host. In particular, main cabinet 112 features a virtual belly glass 125 and a virtual side panel or glass 127, instead of a traditional silk-screened or otherwise statically labeled belly glass and side glass. In addition, top box 111 features a virtual top glass 133 rather than a traditional silk-screened top glass or otherwise static label. Although virtual glasses are shown in three separate places here, it is specifically contemplated that fewer or more virtual glasses can be used in any combination as desired in a given instance, and that any and all other locations on and about the gaming machine or other device can be adapted for use with a virtual glass. Furthermore, each virtual glass can vary in size and shape as needed to conform to whatever physical specifications may be necessary.

In general, each virtual glass comprises at least a video display device that can be used for presenting a potentially infinite assortment of visual displays, such as, for example, a main game, a copy of a main game, a bonus game, animated or static pictures or artwork including game related themes, video clips, advertisements, pay tables, other pertinent information and any other visual display presentation. The actual video display device can be selected from any of a number of different video display types, including, by way of example, any standard LED, LCD or CRT, a "thin" CRT, a high resolution flat-panel LCD, a plasma display, a field emission display, a digital micromirror device, and any other electronically controlled video monitor, as well as a hologram or any other three-dimensional projected imaging device. In addition, any display device used in a virtual glass can be adapted for use as an input-accepting device, such as a touch screen, if desired. One example of such a touch screen or other interactive display device used in connection with a gaming machine is disclosed in commonly assigned and co-pending U.S. patent application Ser. No. 10/139,801, by Winans, et al., filed May 3, 2002, and entitled "Light Emitting Interface Displays for a Gaming Machine," which application is incorporated herein in its entirety and for all purposes. Each virtual glass may also comprise or be associated with one or more additional speakers, microprocessors or other electronic components, as discussed in greater detail below.

Unlike the secondary or other auxiliary gaming machine video displays disclosed in commonly assigned U.S. Pat. No. 6,315,666, the various embodiments of virtual glass in the present invention are not event-driven media-slave type devices that require a substantial amount of separate and independent memory or storage. Rather, each virtual glass is preferably media-driven, such that all presented images, sounds and other display materials are not permanently stored on the virtual glass, but instead are delivered by an associated host to the virtual glass for display. In this manner, it is not necessary for a virtual glass to have a substantial amount of ROM, flash RAM, dynamic RAM or other associated electronic storage, as would be required for an event-driven, media-slave video display device. Because a virtual glass is media-driven rather than event-driven, it is also unnecessary for a controlling MGC or other associated host to regularly communicate state information and event commands to the virtual glass. In fact, in one embodiment it is specifically contemplated that a given static image substantially resembling a traditional silk-screened glass be sent one time to a virtual glass by an associated host, whereupon that static image is stored in the virtual glass by a relatively small flash RAM or dynamic RAM unit, and then repeatedly displayed on the virtual glass, thus becoming a virtual silk-screened image.

Figure 3:
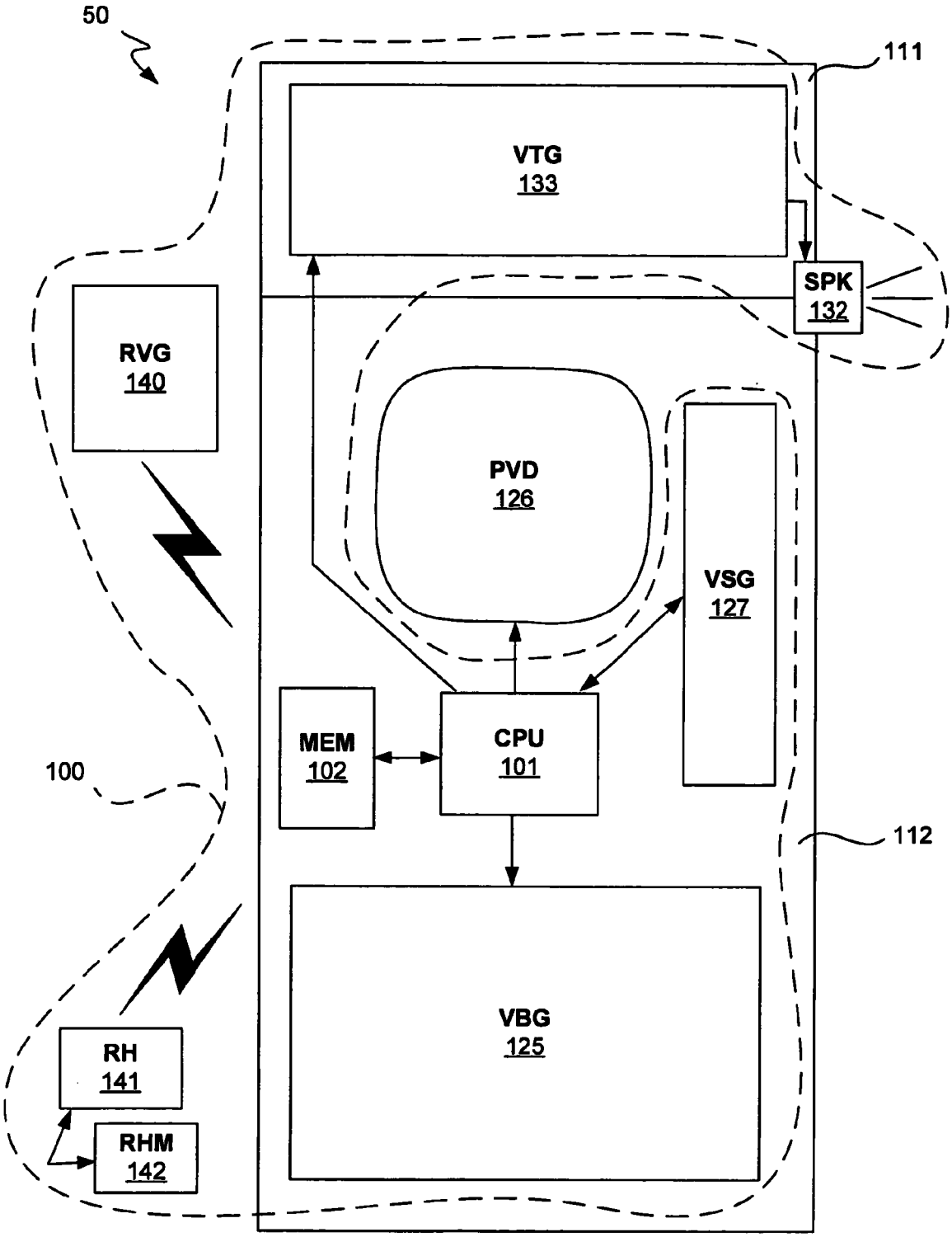
FIG. 3 illustrates a block diagram of an exemplary electronic component infrastructure for generating and controlling video displays in a gaming machine according to one embodiment of the present invention.

Turning now to FIG. 3, a block diagram of an exemplary electronic component infrastructure for generating and controlling video displays in a gaming machine according to one embodiment of the present invention is illustrated. Virtual glass display system 100, which generally resides within and/or about gaming machine 50, comprises a plurality of components, each of which are separate and distinct from the primary CPU or MGC 101. Such a primary CPU or MGC 101 can be, for example, a model i960 type of CPU, manufactured by Intel Corporation of Santa Clara, Calif., which model is present in many gaming machines manufactured by IGT of Reno, Nev., such as many of those under the Game King and Vision labels, as well as various other electronic gaming machines. In fact, i960 type and similar types and variations of CPUs are present in many types of electronic gaming machines, and inclusion of not only i960s but all types and variations of CPUs are contemplated for use in the present invention. CPU 101 is generally responsible for controlling and/or processing all elements of game play, money or credit intake, payouts, driving auxiliary peripherals, any network communications (if applicable), and other machine functions, as is generally known in the art.

CPU 101, which is the MGC for gaming machine 50, is preferably placed in communication with one or more associated storage units 102, which storage units may comprise ROM, RAM, static RAM or any other practicable type of memory or data storage, or any combination thereof. In addition, one or more memory units 102 may reside directly in or on CPU 101, or may be separate and in communication with the CPU, and may comprise, for example, a hard disk, a disk drive, a flash drive or any other type of data storage hardware unit. Since it is the MGC of the gaming machine, CPU 101 is preferably also the driver for a primary video display ("PVD") monitor 126, with this primary display monitor being used to present at least a main game and result, among other display information and items. Although possible in some instances, PVD 126 is generally considered not to be a good candidate for a virtual glass, due to its substantially different nature from other displays with respect to at least some display contents and in its relationship to the MGC and game in general. Accordingly, PVD 126 is not a virtual glass in the present example and is not considered to be a part of the virtual glass display system 100 as illustrated.

As disclosed previously, CPU 101 (i.e., the MGC) is preferably associated with one or more virtual glasses within gaming machine 50, such as virtual belly glass ("VBG") 125, virtual side panel glass ("VSG") 127 and virtual top glass ("VTG") 133. In the present example, CPU 101 is in communication with each virtual glass 125, 127, 133, and under such an arrangement this MGC is considered to be a host for each virtual glass, with the host being responsible for sending any and all images, animations, video clips, sounds and other materials that the host wants displayed by a virtual glass. Although it is entirely possible for fewer or more virtual glasses to be included in a given gaming machine, as disclosed previously, it is also possible for one or more hosts to be associated with a given gaming machine at any one time. In fact, a plurality of different hosts can be within and/or outside the gaming machine, as discussed in greater detail below, although the present focus will remain on just the MGC as a host for now. While communication thus obviously occurs from the MGC host to each virtual glass, in some cases it may also be desirable for communication to proceed from a virtual glass back to the MGC, such as, for example, where VSG 127 can be an input accepting touch screen type of display, whereupon it is then necessary for input made at the touch screen to be relayed back to the MGC for processing.

As discussed in greater detail below, each virtual glass preferably comprises a few basic electronic components, including at least one simple processor or programmable logic device ("PLD") and at least one relatively small memory or storage unit, such as a flash RAM or dynamic RAM, capable of temporarily storing at least one static image, display file or other set of display related data. Such a static image file or set of display related data can then be accessed repeatedly by the processor once it is so stored, such that the host must send any particular static image file or set of data only once for that image or related display to be displayed constantly for an indefinite period of time. In one exemplary mode of operation, a virtual glass receives a static image file from the issuing host, temporarily stores that static image file in a low capacity flash RAM unit, and then repeatedly reads that static image file and casts the image contained therein onto the virtual glass video display at least until another image file is stored in the flash RAM unit and/or the virtual glass is otherwise ordered to stop displaying its flash RAM contents.

In a particular example of static image files or data sets being sent to the various virtual glasses, a player may select one from a variety of game choices on a given multi-game machine, whereupon the MGC, which is also the host CPU 101, sends to each virtual glass a file or data set for a static graphical art thematic image reflective of that particular player selected game. Such a game can be an "Elvis" or "Star Wars" themed game, for example, both of which can then be made available on the same gaming machine. During the entire time that the player plays that selected game on that gaming machine, each virtual glass repeatedly displays its stored static thematic image reflective of that game, resulting in constant visual displays that essentially emulate traditional thematic silk-screened glasses. Because the MGC sends each image just once and is then no longer involved with driving or monitoring each virtual glass display during game play, an enormous amount of machine resources and MGC activity are advantageously saved, with such resources and MGC activity then being available for other processes or enhance primary game features.

Of course, a new image or video display can be sent to each virtual glass for any number of reasons. A player may choose to select a different game, for example, whereupon the host MGC can then send files or data sets for static graphical art thematic images reflective of that newly selected game to each virtual glass for constant display in the same manner detailed above. Alternatively, if game play should stop for a given period of time, the host MGC may be programmed to send a separate set of image files or data sets to each virtual glass on its own. In this manner, a multi-game machine can be programmed to automatically rotate complete sets of virtual glass displays for many or all of the various possible games and themes available on that machine during a player attract phase or other similar down time. It is also contemplated that a wide variety of other video image files or data sets can be sent to a virtual glass to display for either an indefinite or set period of time, with such images including, for example, pay tables, other machine information, general casino and hotel information, other advertising, copies of recent main game results, and screen images of recent jackpot wins, among others.

In addition, other types of video displays that can be accommodated by the limited flash RAM or dynamic RAM capacity are also contemplated, with examples including multiple frame animations and short video clips. Of course, due to the limited storage constraints of the associated flash RAM or dynamic RAM, the length of a video clip is effectively constrained by its resolution, with a high-resolution clip being necessarily very short. Finally, it is also contemplated that the video display device for one or more virtual glasses may also be utilized separately for different modes of operation, such as for a primary game display, a copy of a primary game display, or for displaying a direct feed of live or taped video, for example. In such instances it is likely that such other modes are entirely inconsistent with the features associated with a virtual glass display, in that increased MGC load becomes necessary and/or cycled reuse of stored files or data sets in the virtual glass flash RAM or dynamic RAM does not occur, such that one or more additional independent inputs to the virtual glass display device would likely be required. The availability of such different modes of operation, however, is simply considered to be a convenient override feature of the standard virtual glass mode that can be utilized in conjunction with a virtual glass video display device.

Referring again to FIG. 3, each virtual glass may be associated with one or more speakers 132, with such associations being either exclusive for a given virtual glass, or shared with other virtual glasses and/or other machine components. For example, while speaker 132 is clearly associated with VTG 133 in the present illustrative example, it is also possible that CPU 101 can have a direct connection (not shown) with this speaker in order for this acting MGC to provide separate and independent audio display content and commands. In this manner, VTG 133 can issue audio content related to its video display content to this speaker 132, while CPU 101 is also able to issue separate audio content to the speaker. Speaker 132 may be programmed to recognize and prefer one audio content issuing device over another, or may contain a simple PLD to process, queue and resolve conflicting audio commands by a predetermined priority or other similar method, such a practice as will be readily understood by those skilled in the art.

Virtual glass display system 100 may also comprise one or more associated remote units, such as remote virtual glass ("RVG") 140 and remote host ("RH") 141, with such remote units being those that are not contained within the gaming machine itself. RVG 140 operates much like any other virtual glass within gaming machine 50, and is accessible to at least one host associated with the gaming machine, such as CPU 101 or any other additional internal host (not shown). RH 141 operates much like CPU 101 or any other internal host with respect to one or more associated virtual glasses, with RH 141 or any such additional internal host preferably having access to one or more associated virtual glasses 125, 127, 133, 140. Any such additional host preferably comprises a processing unit and at least one associated or accessible memory or storage unit, such as remote host memory ("RHM") 142. Any number of associated remote units such as RVG 140 or RH 141 may reside in a variety of locations, such as attached to any outside portion of the gaming machine, nearby but above, below or next to the gaming machine, and/or remotely located from the gaming machine at some distance, as desired. In fact, a remote unit may reside in a different building or even a different city from an associated gaming machine, as permitted by the communication means and protocols used.

Communication means and protocols for both internal and remote virtual glass units can vary widely as desired, with one exemplary use and description for standard peripheral communications within a gaming machine being disclosed in commonly assigned U.S. Pat. No. 6,251,014 to Stockdale, et al., entitled "Standard Peripheral Communication," which patent is incorporated herein in its entirety and for all purposes. Virtual glass communications can be made both internally within a single machine, or alternatively over a network of machines and/or servers, such as a WAN or LAN, for example. Hard-wired types of communications and protocols that can run between machines, devices and servers can include, for example, those involving Universal Serial Bus ("USB"), Firewire and proprietary cables and bus technologies. In a preferred embodiment, one or more virtual glass units are adapted to implement a communication protocol that allows such virtual glasses to be identified by the master gaming controller of an associated gaming machine as a device authorized to connect to the master gaming controller, particularly where the virtual glass also comprises a source of player input, such as in the case of a touch screen. Particular examples of such USB software, connections and protocol usage in devices within and associated with gaming machines are disclosed in commonly assigned and co-pending U.S. patent application Ser. Nos. 10/460,822, by Lam, et al., entitled "USB Software Architecture in a Gaming Machine;" 10/460,826, by Quraishi, et al., entitled "Protocols and Standards for USB Peripheral Communications;" and 10/460,608, by Quraishi, et al., entitled "Download Procedure for Peripheral Devices," all of which were filed Jun. 11, 2003, and all of which are incorporated herein in their entirety and for all purposes.

Alternatively, any practicable wireless technology may also be implemented for communications between a host and virtual glass, including, for example, a Bluetooth® Wireless system utilizing an IEEE 802.1x standard, an alternative wireless system utilizing a similar wireless fidelity ("Wi-Fi") standard, and any other system having standard wireless communication means and protocols. Exemplary systems and methods of providing and receiving wireless communications between various devices within and associated with a gaming machine are disclosed in commonly assigned and co-pending U.S. patent application Ser. No. 10/661,404, by Silva, et al., filed Sep. 11, 2003, and entitled "Wireless Input/Output and Peripheral Devices on a Gaming Machine," which application is also incorporated herein in its entirety and for all purposes.

Figure 4:
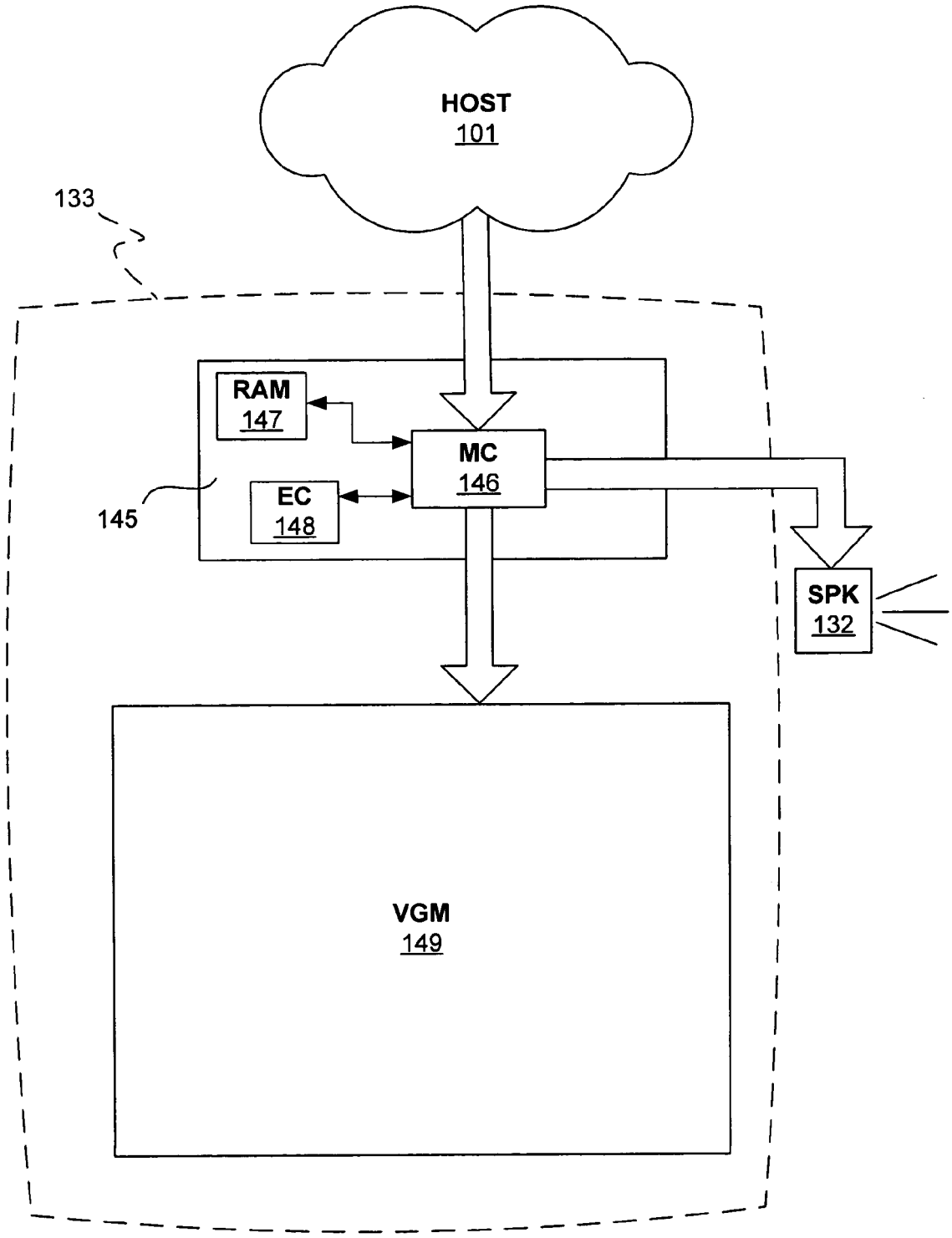
FIG. 4 illustrates a block diagram of an exemplary virtual glass unit according to one embodiment of the present invention.

Turning now to FIG. 4, an exemplary virtual glass according to one embodiment of the present invention is illustrated in block diagram format. Virtual glass 133, which is substantially identical to VTG 133 of FIG. 3, receives input from a host 101 and provides display outputs to a virtual glass monitor ("VGM") 149, which is considered to be part of the virtual glass, and/or an associated speaker 132. Inputs are first received and acted upon by the virtual glass by one or more electronic components on a printed circuit board ("PCB") 145 or other like organizing device. In one simple embodiment, a microprocessor component ("MC") 146 or other like logic device first receives the image, video file or other display related data set issued by a host, and in turn stores the data onto an associated storage device or memory unit, such as flash RAM 147. A video controller, which may be a part of MC 146, then repeatedly reads the file or data set stored in flash RAM 147 and forwards the image contained therein to be displayed on VGM 149 until the virtual glass is given another set of display data or otherwise instructed to stop displaying on the VGM. Alternatively, the video controller may be a separate device distinct from the MC 146 or other like logic device. Such an arrangement may be desirable due to design preferences, cost considerations, availability of off-the-shelf parts and other factors.

Hence, a virtual glass system has at least one host adapted to present video content to a virtual glass, at least one host memory unit or other storage device in communication with the host and adapted to store video content accessible to the host, and at least one virtual glass in communication with the host. A standard virtual glass then has at least one logic device, at least one virtual glass storage unit and one video display device, although the virtual glass storage units are so small that the combined capacity of all virtual glass storage units is substantially less than the combined video content capacity of all host storage units. While flash RAM 147 has a limited memory capacity, such that virtual glass 133 is simple and streamlined in comparison with other conventional secondary video display peripherals, the existence of this flash RAM or a similar memory or storage component is vital if a virtual glass is to function as a closed loop type of repeating image display.

In one embodiment, flash RAM 147 is preferably designed such that it can be overwritten with new files or data sets on command, but such that a given data set, file or series of files (such as for a multi-frame animation) remain in memory or storage until they are erased, overwritten, or otherwise formatted away. Flash RAM 147 is hence nonvolatile enough to retain a stored image file or data set in the event that a machine shutdown or other irregular event occurs. While such a file or data set may be singularly small, preservation of such a small amount of video data may be critical in some instances. For example, a gaming machine may be programmed to send a screen shot or series of screen shots to one or more virtual glasses when any significant jackpot occurs in a main game on the gaming machine. In the event that a machine shutdown or malfunction occurs after the jackpot, the flash RAMs of one or more virtual glasses can be used to recall screen shots involved in a purported jackpot. Exemplary uses and descriptions for preserving and playing back a game history for a gaming machine, and for presenting game history frames at locations at alternative locations within and outside a gaming machine are disclosed in commonly assigned and co-pending U.S. patent application Ser. No. 09/689,498 by LeMay, et al., filed Oct. 11, 2000, and entitled "Frame Buffer Capture of Actual Game Play," which application is incorporated herein in its entirety and for all purposes.

Because the static nature of RAM 147 is not critical for all virtual glass implementations, however, other forms of storage may also be used. For example, RAM 147 may comprise a dynamic RAM device that does not retain files or data in memory or storage upon a shut down or power outage. While the loss of any stored data may be disadvantageous in some instances, relatively cheaper dynamic RAM units may be desirable where the preservation of such stored data in the virtual glass itself is not deemed to be important. In such instances, it is specifically contemplated that any lost images due to shut down or power outages can simply be resent to an affected virtual glass by an appropriate associated host.

In a more advanced embodiment, one or more additional electronic components ("ECs") 148 within the virtual glass may be desired. Such an additional EC could be, for example, a separate video controller, an added processor, a PLD, a field programmable gate array or an added flash RAM or dynamic RAM unit capable of storing one or more added video files or data sets, among others. As illustrated, EC 148 simply represents an additional flash RAM unit, such that virtual glass 133 is capable of temporarily storing video files or data sets in two different associated places at one time, which can be advantageous for a number of reasons. In one particular example involving two separate and independent video displays for one virtual glass, a Mega Jackpot amount or other pertinent information can be displayed on a virtual glass in an overlaid or embedded fashion within a separate, dominant static image for that same virtual glass. Other EC types may require different PCB configurations, such as, for example, a simple PLD used as a buffer unit between the host 101 and MC 146, with the PLD being connected to both the flash RAM 147 and MC 146.

Alternatively, it may be desirable to have an advanced MC or one or more additional specialized microprocessors, depending on various added functionalities that may be desirable for a particular virtual glass. For example, it may be desirable for a particular virtual glass to be able to display a series of frames in an animation-like sequence, decompress files issued in a compressed format, and/or be able to scale images depending on image size variances with respect to display space. It may also be desirable for a virtual glass to have anti-aliasing algorithms and abilities and/or be able to buffer multiple images from multiple media types. Other desirable traits may include the ability to execute scripts, such as Java® or any other proprietary script, for use with input accepting touch screens, and/or the ability to render issued 3-D images into 2-D images, such as through the use of a virtual real-time modeling language ("VRML"). Exemplary systems and methods for rendering and providing 3-D images in a gaming machine are disclosed in commonly assigned and co-pending U.S. patent application Ser. No. 09/927,901, by LeMay, et al., filed Aug. 8, 2001, and entitled "Virtual Cameras and 3-D Gaming Environments in a Gaming Machine," which application is incorporated herein in its entirety and for all purposes. In any of the foregoing instances, a digital signal processor ("DSP") or other like device may be a desirable additional EC within the virtual glass.

While one or more such added ECs can certainly be utilized, it should be remembered however that one objective of the virtual glass is to provide added visual displays having a low amount of memory or storage, simpler processing units and less accompanying infrastructure. With the need to continuously drive one or more auxiliary video displays eliminated, the overall workload on a main processor board, MGC, and other associated hardware is substantially reduced. With no need to waste MGC cycles to repeatedly service static images being used to replace glass art, there is less demand on the central processing assembly, which in turn reduces heat and other undesirable effects of an overburdened MGC. It is preferable that at least some advantages realized by a less burdened MGC also be realized in a streamlined, low space, low power and low cost virtual glass. It is thus preferable that added ECs and other structures to a given virtual glass be minimal in nature. Accordingly, it may be desirable that any necessary heavy processing work, such as a 3-D to 2-D rendering, be done by a host or other outside processor, such that the data is simply transferred to the virtual glass for presentation, thereby minimizing the number and complexity of processors and components within the virtual glass as much as possible.

Should such added processing work be regularly expected, however, it may be desirable to specifically include a separate processor as a virtual glass host for a gaming machine, such that the MGC is not unnecessarily overburdened. In fact, it is specifically contemplated that a plurality of both internal and external virtual glass hosts be associated with a given gaming machine. Such hosts may be related, such as on a particular gaming machine network, or may be fully separate and independent from each other. For example, one host may be the gaming machine MGC, while another may be a remote autonomous host that issues advertisements for a casino or hotel to various virtual glasses, with such video data specific to an establishment operating the gaming machine being stored on an associated host memory or storage unit. One desirable effect of utilizing multiple hosts in association with a given virtual glass is that video images, clips and other files and data sets can be more readily stored in a plurality of locations within and outside a gaming machine or remote virtual glass.

Figure 5:
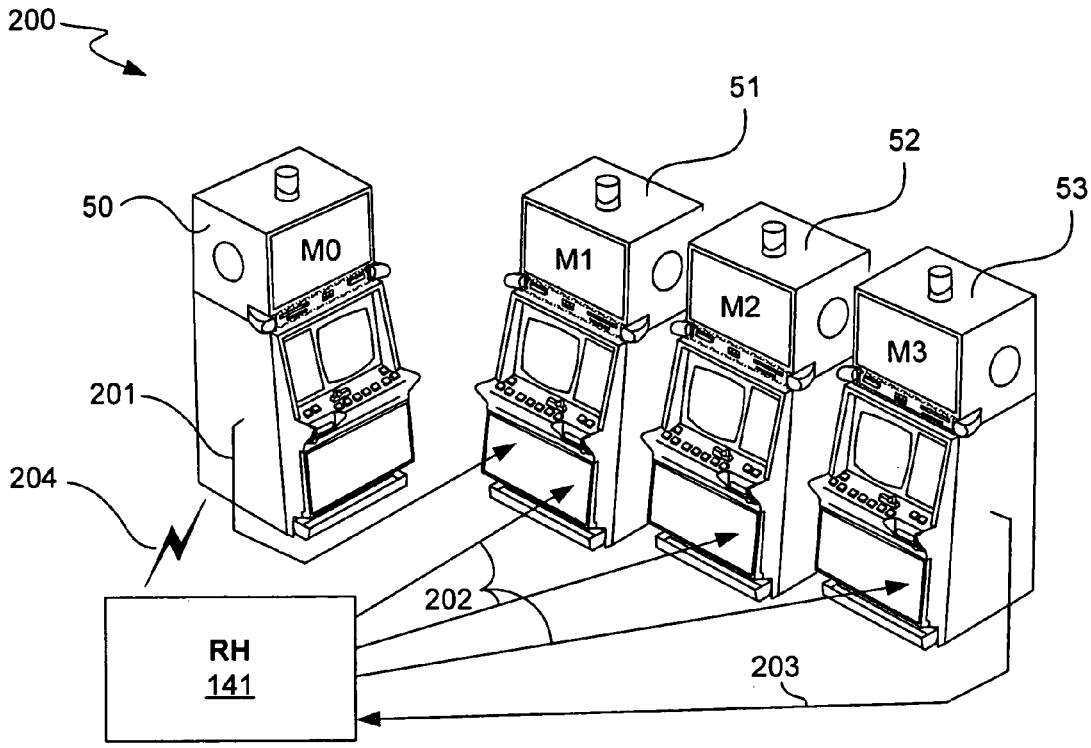
FIG. 5 illustrates a block diagram of an exemplary gaming machine network for providing networked virtual glasses according to one embodiment of the present invention.

Turning to FIG. 5, a block diagram of an exemplary gaming machine network for providing networked virtual glasses is illustrated. Gaming machine network 200 comprises a plurality of gaming machines 50-53 and at least one RH 141, which can be, for example, a primary server or other virtual glass master host. A primary gaming machine ("M0") 50 can be in direct communication with at least a first separate gaming machine ("M1") 51, such that M0 can function as a host for one or more virtual glasses in M1. Such communication from M0 to M1 can occur over, for example, a hard-wired communication line 201. In addition, the RH 141 serves as a remote host to virtual glasses in each of M1 50, a second separate gaming machine ("M2") 52 and a third separate gaming machine ("M3") 53, with appropriate video content being sent to the various virtual glasses in each machine via hard-wired communication lines 202. Because it may be desirable for hosts within one or more gaming machines to provide content to other machines directly or via an intermediary conduit such as RH 141, each machine may have return communication abilities with RH 141, such as hard-wired connection 203 from M3 53. Wireless communications between the various remote hosts and virtual glasses may also be available if desired, such as the wireless two-way communication 204 provided between M0 50 and the remote host 141. Of course, added communications from more hosts to more virtual glasses are also possible, such that every host within network 200 can potentially be associated with every virtual glass in the network.

As seen from this example, each gaming machine in a given bank or grouping of machines can potentially be a host for one or more virtual glasses in some or all of the other machines in that group. In such an arrangement it may be desirable to display, for example, a current jackpot or other immediately vital information from one gaming machine on at least one virtual glass of every machine in that group. Alternatively, it may be desirable for a remote host to utilize some or all associated virtual glasses in many associated machines in another helpful manner. For example, a given group of virtual glasses can be utilized to assist with providing directions for a casino guest. In such an instance, a command to provide directional help from a front desk to a particular buffet can be issued from an employee to a networked system having a master remote host. A series of virtual glasses can then provide arrows or other indicative displays sequentially as the guest proceeds from the front desk to the buffet or other desired destination within the establishment.

Figure 6:
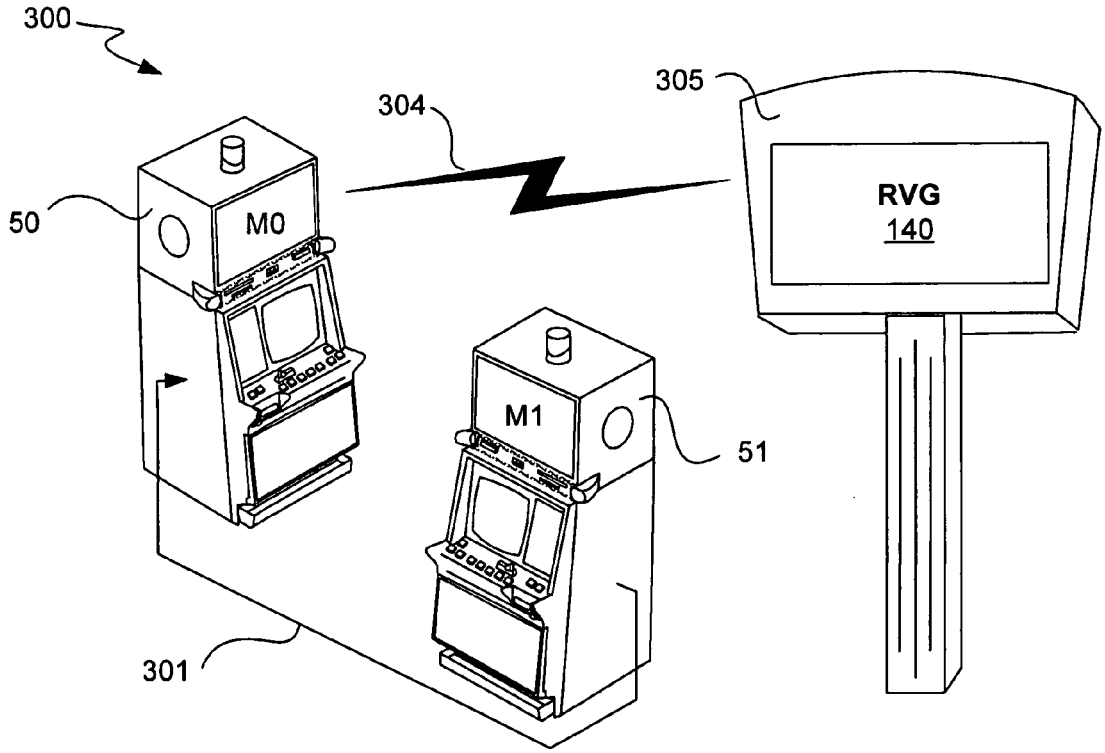
FIG. 6 illustrates a block diagram of an alternative exemplary gaming machine network for providing networked virtual glasses according to another embodiment of the present invention.

Referring now to FIG. 6, a block diagram of an alternative or additional portion of an exemplary gaming machine network for providing networked virtual glasses is illustrated. As in the foregoing embodiment, a gaming machine network 300 comprises a plurality of gaming machines, such as a primary gaming machine ("M0") 50 and at least one separate gaming machine ("M1") 51. Network 300 also comprises a remote virtual glass ("RVG") 140, which can be, for example, a marquee display on a casino floor, an associated hotel or restaurant lobby, or on a sign outside the casino. RVG 140 could also comprise a carousel display for displaying a Megabucks Jackpot or other information for a bank of gaming machines, whereupon a single gaming machine 50 could act as a primary host for the carousel display bank, eliminating the need for additional carousel related equipment. RVG 140 can thus be associated with multiple hosts, or may be connected for restricted control purposes to only a single host, such as M0 50. Again, communications between a host M0 50 and RVG 140 can be through any practicable means desired, such as a hard-wired or wireless connection 304. Should another associated gaming machine, such as M1 51, desire to forward video contents for display on RVG 140, it may be necessary for the other host or hosts to provide such content indirectly by forwarding to the primary host 50, such as through connection 301. Of course, this connection can also be used as a means for M1 51 being a direct host for one or more virtual glasses in M0 50.

With the potential for so many hosts being associated with any given virtual glass, it may be preferable to use a PLD or other processor within each virtual glass to prioritize conflicting content from one host over another. Similar to the case of conflicting commands to a speaker above, a processor or PLD can be used to process, queue and resolve multiple commands by multiple hosts by a predetermined priority, or other similar method, such a practice as will be readily understood by those skilled in the art. For example, a first-in first-out ("FIFO") approach can be used, whereby video content is displayed in the order received. Preferably though, the PLD or other processor can be programmed to recognize various levels of priority both in hosts and in type of content. For example, a top-level host could be a master remote host, such as a network level primary server for the entire casino, with a local remote host for a particular floor region being next in line, an MGC or other internal CPU for the given machine being next, and remote host MGCs or CPUs within neighboring gaming machines being last. A top priority for video content might be emergency related information, followed by security related information, neighboring jackpot information, immediate game play artwork displays, and finally random advertisements for use during down time.

It is specifically contemplated that the virtual glass apparatuses disclosed and detailed above can be utilized not only in newly manufactured gaming machines and other electronic components, but can also be implemented into existing gaming machines and other devices by removing various existing components in those machines and devices as necessary. For example, while one or more original video displays may remain in a given machine, such as for primary game play, it is contemplated that at least one virtual glass be installed as a top glass, belly glass or other associated machine display to replace any existing traditional silk-screened glass, secondary video display or other visual display in or about the machine.

In addition, it is also specifically contemplated that the number, shape, size, orientation and planarity of a virtual glass video display device or devices not be limited in any way. For instance, the shape of a video monitor or screen need not be rectangular, as such monitors may also be round, ovular, triangular, hexagonal, or shaped in any other way desired, including shapes that form part of the exterior artwork on the gaming machine. In addition, one or more monitors or screens can be used in combination to form one virtual glass, and such a group of screens or plurality of virtual glasses could be linked together to provide a frame around a primary video display screen, such as in a square formation with a "hole" in the middle for the primary screen. Furthermore, it is not necessary that virtual glass video monitors or screens be planar, as such screens can be designed to conform to any surface on the gaming machine as desired. For example, a 360-degree curved virtual glass display made up of one or more curved screens may be located above or adjacent to an associated gaming machine. Alternatively, one or more screens may wrap around various surfaces, such as might be possible with "electronic paper" type screens. Finally, it is also contemplated that a virtual glass display device can be holographic in nature, such that a conventional "monitor" is not even necessary.

Although the foregoing invention has been described in detail by way of illustration and example for purposes of clarity and understanding, it will be recognized that the above described invention may be embodied in numerous other specific variations and embodiments without departing from the spirit or essential characteristics of the invention. Certain changes and modifications may be practiced, and it is understood that the invention is not to be limited by the foregoing details, but rather is to be defined by the scope of the appended claims.

What is claimed is:

1. A gaming machine configured to accept wagers and grant monetary awards, comprising:

a master gaming controller configured to process gaming machine state information and event commands;

a main display device;

at least one virtual glass;

a first host configured to transmit video content to the at least one virtual glass, each said at least one virtual glass being separate from the main display device, and the first host; and at least one host storage unit being separate form said at least one virtual glass, the at least one host storage unit configured to communicate with said first host, each said at least one host storage unit having a video content capacity that stores the video content; wherein:

the at least one virtual glass is configured to communicate with said first host, said at least one virtual glass comprising at least one virtual glass storage unit, a display device, and at least one logic device configured to process the video content transmitted by said first host, each said at least one virtual glass storage unit having a capacity;

a combined capacity of all said at least one virtual glass storage units within said virtual glass is substantially less than a combined video content capacity of all said at least one host storage units; and said at least one virtual glass is an exclusively media-driven device configured to operate without receiving communications of the gaming machine state information and the event commands.

2. The gaming machine of claim 1, wherein said first host comprises the master gaming controller.

3. The gaming machine of claim 1, wherein said at least one virtual glass storage unit comprises flash RAM.

4. The gaming machine of claim 3, wherein said flash RAM is configured to be readily erasable or overwritable, and is also sufficiently nonvolatile so as to be retrievable after a machine shutdown or other malfunction.

5. The gaming machine of claim 1, wherein said at least one virtual glass storage unit comprises dynamic RAM.

6. The gaming machine of claim 1, wherein said at least one host storage unit comprises at least one of a hard disk, a disk drive, and a flash drive.

7. The gaming machine of claim 1, wherein said at least one host storage unit stores video content specific to an establishment operating the gaming machine.

8. The gaming machine of claim 1, wherein said display device is selected from the group consisting of cathode ray tubes, liquid crystal displays, plasma displays, field emission displays, digital micromirror devices, touchscreens, and combinations thereof.

9. The gaming machine of claim 1, further comprising: a master gaming controller, wherein said virtual glass is configured to implement a communication protocol that allows the at least one virtual glass to be identified by said master gaming controller as a device authorized to connect to said master gaming controller.

10. The gaming machine of claim 1, wherein said at least one virtual glass is provided in a top box portion of the gaming machine, said top box portion being located above a main cabinet portion of the gaming machine.

11. The gaming machine of claim 1, wherein said at least one virtual glass is provided in a belly glass region of the gaming machine, said belly glass region being located on a main cabinet portion of the gaming machine.

12. The gaming machine of claim 1, wherein said at least one virtual glass is provided in a side panel region of the gaming machine, said side panel region being located on a main cabinet portion of the gaming machine.

13. The gaming machine of claim 1, wherein said at least one virtual glass is provided in a remote location from the gaming machine, said remote location being separate and apart from the remainder of the gaming machine.

14. The gaming machine of claim 1, wherein said at least one virtual glass is configured to decompress video content presented in a compressed format.

15. The gaming machine of claim 1, wherein said at least one virtual glass is configured to scale video content presented in an undesirable size.

16. The gaming machine of claim 1, wherein said at least one virtual glass comprises one or more anti-aliasing algorithms and is configured to utilize at least one of said algorithms to alter presented video content.

17. The gaming machine of claim 1, wherein said at least one virtual glass is configured to execute scripts in association with presented video content.

18. The gaming machine of claim 1, wherein said at least one virtual glass is configured to render presented video content in a 3-D format into a 2-D format.

19. The gaming machine of claim 1, wherein said first host is provided in a remote location from the remainder of the gaming machine, said remote location being separate and apart from the remainder of the gaming machine.

20. The gaming machine of claim 1, wherein said gaming machine is incorporated into a network of gaming machines comprising at least one of an additional host and an additional virtual glass.

21. A virtual glass comprising:

a display device;

at least one logic device; and at least one virtual glass storage unit, each said at least one virtual glass storage unit having a capacity, wherein:

the virtual glass is configured to be part of a gaming machine, said gaming machine being configured to accept wagers and grant monetary awards, and comprising a master gaming controller configured to process gaming machine state information and event commands, a main display device, the virtual glass, a first host configured to transmit video content to the virtual glass, and at least one host storage unit;

the virtual glass is separate from the main display device, the first host, and the at least one host storage unit;

the at least one logic device is configured process the video content transmitted by said first host;

a combined capacity of all virtual glass storage units within said virtual glass is substantially less than a combined video content capacity of all said at least one host storage units, and the at least one virtual glass is an exclusively media-driven device configured to operate without receiving communications of the gaming machine state information and the event commands.

22. The virtual glass of claim 21, wherein said at least one virtual glass storage unit comprises flash RAM.

23. The virtual glass of claim 21, wherein said at least one virtual glass storage unit comprises dynamic RAM.

24. The virtual glass of claim 21, wherein said virtual glass is incorporated into a network comprising at least one of an additional host and an additional virtual glass.

25. A method of displaying content associated with a gaming machine, the method comprising:

transmitting video content from a first host to a virtual glass, the virtual glass comprising a display device, at least one logic device, and at least one virtual glass storage unit, each said at least one virtual glass storage unit having a capacity, wherein:

the virtual glass is configured to be part of a gaming machine, said gaming machine being configured to accept wagers and grant monetary awards, and comprising a master gaming controller configured to process gaming machine state information and event commands, a main display device, the virtual glass, the first host, and at least one host storage unit;

the virtual glass is separate from the main display device, the first host, and the at least one host storage unit;

the at least one logic device is configured process the video content transmitted by said first host;

a combined capacity of all virtual glass storage units is substantially less than a combined video content capacity of all said at least one host storage units; and the virtual glass is an exclusively media-driven device configured to operate without receiving communications of the gaming machine state information and the event commands; and displaying said video content on said virtual glass.

26. The method of claim 25, further comprising the step of:

storing said video content in said at least one virtual glass storage unit.

27. The method of claim 25, wherein said at least one virtual glass storage unit comprises flash RAM.

28. The method of claim 25, wherein said at least one virtual glass storage unit comprises dynamic RAM.

29. The method of claim 25, wherein said virtual glass is incorporated into a network comprising at least one of an additional host and an additional virtual glass.

30. The method of claim 25, wherein a communication protocol stored on said virtual glass allows the virtual glass to be identified by the master gaming controller of said gaming machine as a device authorized to connect to said master gaming controller.

* * * * *